United States Patent [19]

Sämpi et al.

[11] Patent Number: 4,744,722

[45] Date of Patent: May 17, 1988

[54] METHOD AND APPARATUS FOR THE MIXING OF LIQUID OR GAS INTO PULP STOCK

[75] Inventors: Jukka Sämpi, Pori; Timo Aaltonen, Luvia, both of Finland

[73] Assignee: Rauma-Repola Oy, Pori, Finland

[21] Appl. No.: 921,106

[22] Filed: Oct. 21, 1986

[30] Foreign Application Priority Data

Oct. 21, 1985 [FI] Finland ..... 854105

[51] Int. Cl.[4] ..... F01D 15/00

[52] U.S. Cl. ..... 415/121 B; 415/116; 415/117; 415/131

[58] Field of Search ..... 415/116, 117, 121 B, 415/83, 84, 199.1, 131, 132

[56] References Cited

U.S. PATENT DOCUMENTS

| | | | |
|---|---|---|---|
| 4,378,093 | 3/1983 | Keener | 415/121 B |
| 4,435,122 | 3/1984 | Niskanen et al. | 415/121 B |
| 4,439,096 | 3/1984 | Rockwood et al. | 415/131 |
| 4,619,736 | 10/1986 | Henricson | 415/121 B |

FOREIGN PATENT DOCUMENTS

| | | | |
|---|---|---|---|
| 596705 | 4/1960 | Canada | 415/121 B |
| 365065 | 11/1938 | Italy | 416/223 B |
| 174660 | 4/1955 | Sweden | 415/116 |
| 1020995 | 8/1963 | United Kingdom | 415/116 |

*Primary Examiner*—Robert E. Garrett
*Assistant Examiner*—Therese Newholm
*Attorney, Agent, or Firm*—Burns, Doane, Swecker & Mathis

[57] ABSTRACT

The invention concerns a method and an apparatus for the mixing of liquid or gas into pulp stock. In the method the pulp is fed into a centrifugal pump, into which, at the same time, the material to be mixed is fed into the zone between the center and the outer circumference of the rotor wheel. The apparatus is preferably provided with rotor blades consisting of two parts and with feed pins extending into the gap between the said parts.

10 Claims, 2 Drawing Sheets

METHOD AND APPARATUS FOR THE MIXING OF LIQUID OR GAS INTO PULP STOCK

BACKGROUND OF THE INVENTION

The present invention concerns a method for the mixing of liquid or gas into pulp stock and an apparatus for carrying out the method.

The flow-technical properties of a pulp stock of low consistency, i.e. of a stock whose consistency is lower than 5%, correspond to a Newtonian fluid, and such a stock can be pumped by means of centrifugal pumps and propeller pumps. Mixing of liquid or gas into stock of low consistency does not cause particular difficulties. For the pumping of pulp stock of medium consistency, i.e. of a stock whose consistency is 8% to 18%, displacement pumps have been used traditionally. However, it has been noticed that a stock of medium consistency becomes pumpable when it is fluidized, i.e. subjected to a sufficiently rapid shear. A centrifugal pump based on fluidization is described, e.g., in the U.S. Pat. No. 4,435,122. Mixing of liquid or gas into pulp stock in the range of medium consistency is more difficult than in the range of low consistency, mainly because there is little free liquid between the fibres.

SUMMARY OF THE INVENTION

The method and the apparatus in accordance with the invention are suitable for use both within the range of low consistency and within the range of medium consistency. Applications of use of the method are, in bleaching plants, the mixing of reaction chemicals into the pulp stock and, in connection with washers, mixing of diluting water when pulp stock is pumped from one washer to the other while, at the same time, diluting to the input consistency of the next washer.

The most important advantage of the invention is that the mixing of chemicals or water into the pulp stock and the pumping of the stock can be accomplished by means of the same apparatus. In the prior art, it has been necessary to transfer the stock into the mixer by means of a separate pump. This has caused extra investment cost in the form of piping etc. Moreover, by means of the method of the invention, significant economies of energy are obtained, because the energy needed for pumping is also used for mixing. Moreover, by means of the invention an apparatus has been provided that is as small, simple and efficient as possible.

BRIEF DESCRIPTION OF THE DRAWINGS

The invention will be described in the following with reference to the accompanying figures, wherein.

DETAILED DESCRIPTION

Figure 1:
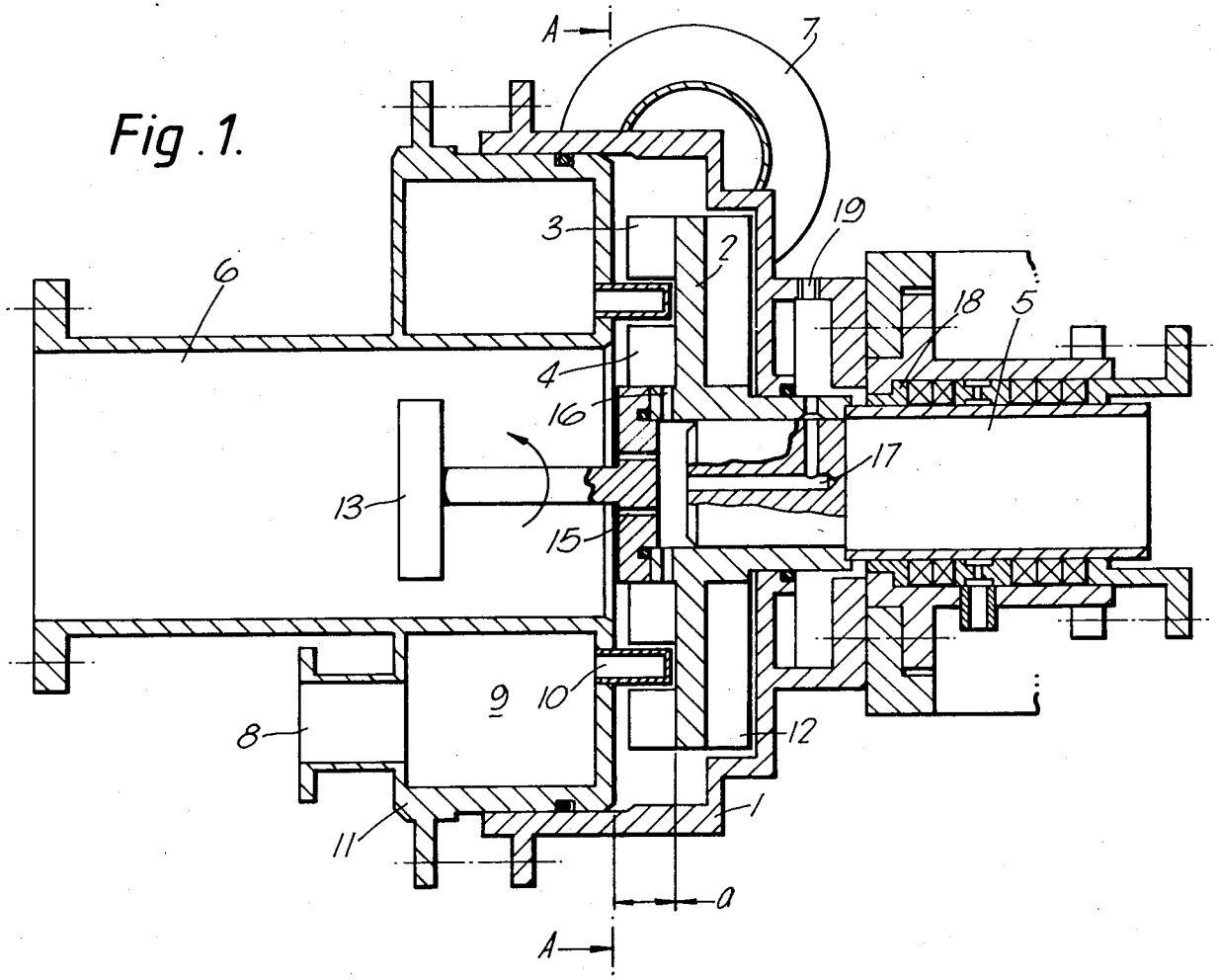
FIG. 1 shows an apparatus in accordance with the invention as a section along the center line.

Reference numeral 1 denotes the housing of the mixer, in which a circular rotor 2 is fitted. The rotor is attached to a shaft 5. At the front side of the rotor, there are blades consisting of two parts, for example, an outer part 3 an inner part 4, and a gap remaining between the said parts. The pulp stock is fed into the mixer through the inlet opening 6, and it is removed through the outlet opening 7. At the middle of the rotor, attached to the end of a shaft extending in the inlet direction of the stock, there is a paddle mixer 13 for the fluidization of the incoming stock and for its feeding into the rotor.

The gas or liquid to be mixed is fed into the mixer through the duct 8 and is passed from an annular space 9 into the rotor through the pins 10.

Figure 2:
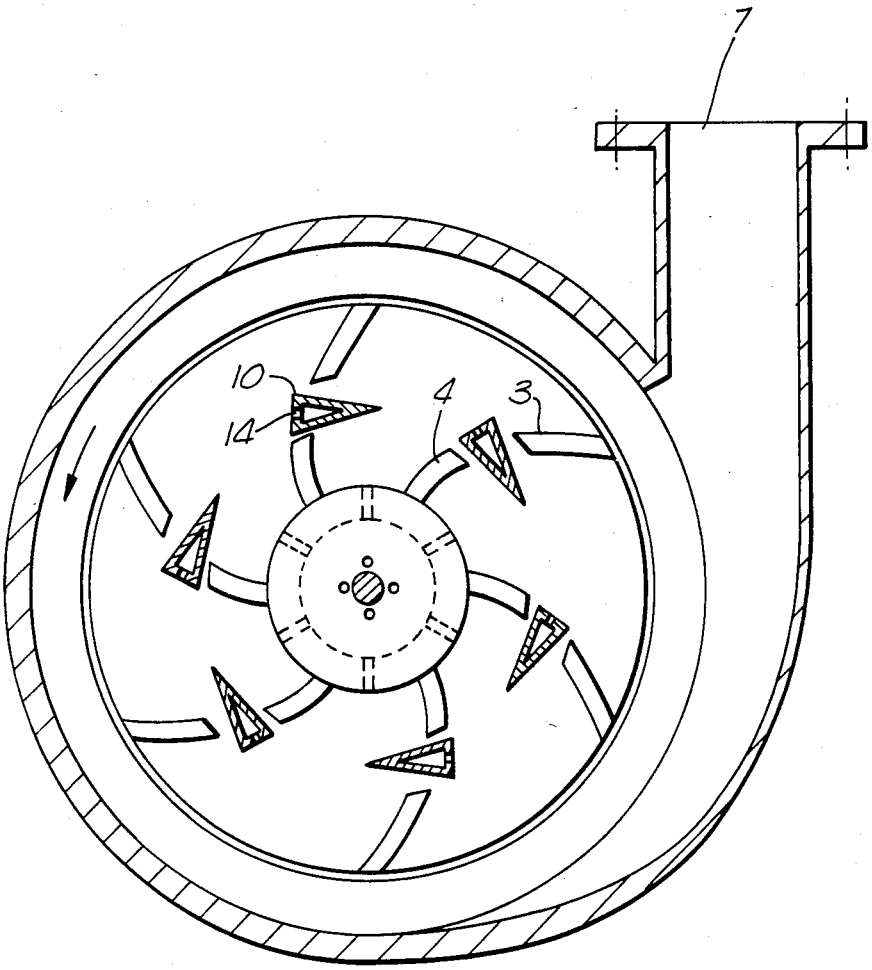
FIG. 2 shows the apparatus as a section along line A—A in FIG. 1.

FIG. 2 shows the rotor as viewed from the front. The pin 10 extends into the gap between the parts 3 and 4 of the rotor blade. In the embodiment shown, there are 6 blades and 6 pins, but their numbers may show variation in different embodiments.

The distance of the pins 10 from the rotor center varies depending on the application. When the substance to be mixed is liquid, it is preferable to place the pins 10 relatively close to the rotor center, because thereby the best mixing is obtained and the pressure required for feeding the liquid is low. When gas is mixed, the gas bubbles attempt to move in the pulp stock towards the rotor center by the effect of buoyancy, where the pressure is lowest. The rotor and the location of the pins are constructed so that the radial speed of the stock in the rotor outwards is higher than the relative speed of a gas bubble caused by buoyancy in the centrifugal field relative to the pulp stock. The radial speed of the pulp stock in the rotor depends on the construction of the rotor as well as on the distance a between the rotor and the front wall (FIG. 1), and on the speed of rotation of the rotor. In the embodiment of FIG. 1, it has been made possible to alter the dimension a so that the front cover 11 of the housing is displaceable.

FIG. 2 also shows a preferable sectional form of the pin 10, which is such that the flow resistance of the pulp stock in the tangential direction is as little as possible. From the point of view of mixing, it is advantageous that the openings 14 in the pin 10 are placed at the trailing side relative to the direction of rotation of the stock. In this way, the liquid or gas to be mixed is passed into the "opening" left by the pin in the revolving pulp stock.

If a relatively large lifting height is aimed at during pumping, the air contained in the pulp stock is separated by the effect of the difference in pressure in the rotor and is gathered at the rotor center. In such a case it is necessary to arrange removal of air out of the rotor center. FIG. 1 shows the air-removing ducts 15, 16, 17, and 18, which pass from the front side via the center and the shaft into the deaeration opening 19.

At the rear side of the rotor, there is also a blade 12, whose function is to prevent gathering of pulp stock behind the rotor.

What is claimed is:

1. Method for the mixing of one of a liquid and a gas into a pulp stock including the steps of:

feeding the pulp stock into a centrifugal pump and out of the pump; and at the same time, feeding one of the liquid or gas to be mixed from a stationary pin extending between rotating blade portions into a zone formed by the pin between a center shaft and an outer circumference of a rotor wheel of the centrifugal pump.

2. The method as claimed in claim 1 further including the step of:

fluidizing the pulp stock before the pulp stock is fed into the centrifugal pump.

3. Apparatus for the mixing of one of a liquid and gas into a pulp stock, which apparatus includes an inlet opening for the stock, an outlet opening for the stock, and a feed opening for either of the liquid or gas, comprising:

a housing provided with a front wall, a rear wall, and a circumference, the inlet opening for the stock being connected with the front wall and the outlet opening for the stock being connected with the circumference of the housing;

a rotor positioned in the housing and provided with an outer circumference, and connected to a rotor shaft passing through the rear wall of the housing;

rotating blade portions on an inlet side of the rotor; and feed equipment including a stationary pin extending between the blade portions for passing one of the liquid or gas to the inlet side of the rotor into a zone formed by the pin between the shaft and the outer circumference, the feed opening being connected to the feed equipment.

4. Apparatus as claimed in claim 3, wherein the rotor blades include an outer part portion and an inner portion, between which there is a gap, the corresponding gap in each blade being placed on the same circumference of a circle, and wherein the feed pin includes holes formed therein for feeding one of the gas and liquid into the gaps.

5. Apparatus for mixing of one of a liquid or gas into a pulp stock, which apparatus includes an inlet opening for the stock, an outlet opening for the stock, and a feed opening for either of the liquid and gas comprising:

a housing provided with a front wall, a rear wall, and a circumference, the inlet opening for the stock being connected with the front wall and the outlet opening for the stock being connected with the circumference of the housing;

a rotor positioned in the housing and provided with an outer circumference, and connected to a rotor shaft passing through the rear wall of the housing;

blades at an inlet side of the rotor;

feed equipment including a feed opening therein for passing one of the liquid or gas to the inlet side of the rotor into a zone between the shaft and the other circumference, the feed opening being connected to the feed equipment;

the blades including an outer part and an inner part having a gap therebetween, the corresponding gap in each blade being placed on the same circumference of a circle, the feed equipment being provided with feed pins each having a hole formed therein for feeding one of the gas and liquid into the gaps; and the feed pins extending into the gap between the inner and outer parts of the rotor.

6. Apparatus as claimed in claim 5 wherein the hole in the feed pin is placed at a trailing side in relation to the direction of rotation of the rotor.

7. Apparatus as claimed in claim 4, wherein the shape of the feed pins is streamlined in relation to the direction of rotation of the rotor.

8. Apparatus as claimed in claim 3, wherein the distance of the front wall of the housing from the rotor is adjustable.

9. Apparatus as claimed in claim 3, including:

other blades on another side of the rotor opposite the inlet side of the rotor.

10. Apparatus as claimed in claim 3, including:

air removing ducts directed through the shaft.

* * * * *